US009243447B2

(12) United States Patent
MacDonald

(10) Patent No.: US 9,243,447 B2
(45) Date of Patent: Jan. 26, 2016

(54) ROLLER SHADE ASSEMBLY ADJUSTMENT MECHANISM

(71) Applicant: David M. Townsley, McKinney, TX (US)

(72) Inventor: E. Arthur MacDonald, McKinney, TX (US)

(73) Assignee: David M. Townsley, McKinney, TX (US)

( * ) Notice: Subject to any disclaimer, the term of this patent is extended or adjusted under 35 U.S.C. 154(b) by 79 days.

(21) Appl. No.: 14/045,695

(22) Filed: Oct. 3, 2013

(65) Prior Publication Data

US 2014/0096920 A1 Apr. 10, 2014

Related U.S. Application Data

(60) Provisional application No. 61/709,216, filed on Oct. 3, 2012.

(51) Int. Cl.

| | |
|---|---|
| ***E06B 9/17*** | (2006.01) |
| ***E06B 9/42*** | (2006.01) |
| ***E06B 9/68*** | (2006.01) |
| ***E06B 9/50*** | (2006.01) |
| ***E06B 9/60*** | (2006.01) |
| ***E06B 9/80*** | (2006.01) |

(52) U.S. Cl.

CPC ... *E06B 9/42* (2013.01); *E06B 9/50* (2013.01); *E06B 9/60* (2013.01); *E06B 9/68* (2013.01); *E06B 9/80* (2013.01); *E06B 2009/801* (2013.01)

(58) Field of Classification Search

CPC ..... E06B 9/56; E06B 9/60; E06B 9/80; E06B 2009/801

USPC ..... 160/315, 321, 323.1, 24, 23.1, 324, 325

See application file for complete search history.

(56) References Cited

U.S. PATENT DOCUMENTS

| | | | | |
|---|---|---|---|---|
| 4,884,618 | A * | 12/1989 | Steeves | 160/321 |
| 5,031,682 | A * | 7/1991 | Tedeschi | 160/315 |
| 7,931,069 | B2 * | 4/2011 | Cannaverde et al. | 160/173 R |
| 8,360,130 | B2 * | 1/2013 | Cannaverde et al. | 160/173 R |
| 2014/0096920 | A1 * | 4/2014 | MacDonald | 160/291 |

* cited by examiner

*Primary Examiner* — Blair M Johnson

(74) *Attorney, Agent, or Firm* — Kelly J. Kubasta; Elizabeth Philip Dahm; Ferguson, Braswell & Fraser, PC

(57) ABSTRACT

In various implementations, a roller shade assembly may include an elongated body and a mechanism. The mechanism may include gears and a spring. The mechanism may allow the roller shade to be locked and/or unlocked using a driver. Internal component(s) of the roller shade may be adjusted using the driver.

13 Claims, 7 Drawing Sheets

ROLLER SHADE ASSEMBLY ADJUSTMENT MECHANISM

CROSS REFERENCE TO RELATED APPLICATION

This application claims priority to U.S. Provisional Patent Application No. 61/709,216, entitled "Close Tolerance Roller Shade Adjustment Mechanism," filed on Oct. 3, 2012, which is hereby incorporated by reference for all purposes.

TECHNICAL FIELD

The present invention relates to roller shades.

BACKGROUND

Roller shades may be used in a variety of applications, such as recreational vehicles, boats, and/or houses. The roller shades may include a tube with a shade. The shade may be rolled about the tube such that the shade may be extended from the tube to provide shade and/or refracted such that at least a portion of the shade wraps around the tube.

SUMMARY

In various implementations, a roller shade assembly may include an elongated body of a roller shade and a mechanism. The mechanism may allow the roller shade to be locked, unlocked, and/or adjusted. The mechanism may include gears and a spring. The gears and/or the spring may allow the roller shade to be locked and/or any adjustments to be maintained.

In various implementations, an assembly may include a mechanism. The mechanism may allow locking, unlocking, and/or adjustment of a roller shade. The mechanism may include gears and spring(s). In some implementations, the mechanism may include a first gear, a second gear, and a third gear. The first gear may include a receiving member adapted to receive a driver. The second gear may be disposed proximate the first gear. The third gear may be disposed proximate the second gear and disposed at least partially in the second gear. The third gear may be disposed at least partially in the first gear in some implementations. The mechanism may include a spring disposed about at least a portion of the third gear. The spring may exert a first force on the second gear to lock a roller shade coupled to the gears.

Implementations may include one or more of the following features. The roller shade assembly may include an elongated body coupled to the mechanism. The elongated body may include a shaft and at least one end cap. One or more internal components of the roller shade may be disposed at least partially in the shaft and/or may be coupled to an end cap. The end cap and the mechanism may be coupled to couple the elongated body of the roller shade assembly to the mechanism. In some implementations, the end cap may include an activator adapted to engage with the mechanism. For example, the activator and a coupling member of the third gear of the mechanism may couple to couple the end cap and/or shaft to the mechanism. The mechanism may include a housing. The gears and/or the spring may be at least partially disposed in the housing. In some implementations, a first end of the mechanism may be coupled to a bracket and/or a second end of the mechanism may be coupled to a shaft of the roller shade.

In various implementations, a roller shade may be adjusted. A driver may be engaged with at least a portion of a first gear of a roller shade. A second gear of the mechanism may be disengaged. One or more internal components of the roller shade may be adjusted by rotating the driver.

Implementations may include one or more of the following features. A driver may be inserted into a receiving member of a first gear of a mechanism. The second gear of the mechanism may be disengaged from a third gear of a mechanism of a roller shade assembly by exerting a force with the driver. Internal component(s) of the roller shade may be adjusted by rotating the driver, which may rotate the first gear of the mechanism. The rotation of the first gear of the mechanism may allow the third gear to rotate. Rotation of the third gear may cause rotation of the coupling member of the third gear. When the coupling member of the third gear rotates, since the coupling member is engaged with the activator of the end cap, adjustment of internal component(s) of the roller shade assembly may be allowed. Rotation of the second gear of the mechanism may be inhibited. For example, the second gear may include recesses, which engage with protrusions of the housing of the mechanism. In some implementations, the roller shade may be locked and/or alteration of the adjustment of the internal component(s) of the roller shade assembly may be inhibited.

In various implementations, the mechanism may allow the roller shade to be locked. A driver may be removed from at least a portion of a roller shade. The spring of the roller shade may be allowed to expand by removing driver. The second gear may be allowed to move towards teeth of a third gear of the mechanism by allowing the spring to expand. The recess (es) of the second gear may be allowed to engage the protrusion(s) of the third gear to lock the roller shade.

Implementations may include one or more of the following features. The roller shade may be unlocked. Unlocking the roller shade may include inserting the driver into at least a portion of the first gear of the mechanism and disengaging the second gear of the mechanism from the third gear of the mechanism by exerting a force with the driver. In some implementations, adjustment of one or more internal components of the roller shade may be allowed by rotating the driver. The roller shade may be locked after allowing adjustment by removing the driver from the first gear of the roller shade, in some implementations.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Roller shades may be utilized in a variety of applications (e.g., recreational vehicles, automobiles, boats, homes, and/or other applications) during daytime and/or nighttime applications. Shades may include solar shades to reduce the amount of light allowed to pass while including at least a portion of transparent and/or translucent material to allow viewing through the portion. The shades may include privacy shades that include at least a portion of opaque material.

The roller shade assembly may be utilized to provide positive engagement via gears in the roller shade assembly. Thus, inadvertent adjustment of internal components of the roller shade may be inhibited (e.g., when compared with roller shades that utilize a spring disposed about an adjustment knob to control internal component settings).

In some implementations, the roller shade assembly may allow locking, unlocking, and/or adjustments via a mechanism of the roller shade assembly. The mechanism may be disposed at least partially in an end cap of a shaft of the body of the roller shade. Thus, a clearance (e.g., light gap) between a shade of the roller shade assembly and the mounting bracket and/or location in which the roller shade is mounted may be reduced. For example, a clearance of less than approximately 0.5 inches and/or less than approximately 0.13 inches may be allowed with the roller shade assembly.

Figure 1:
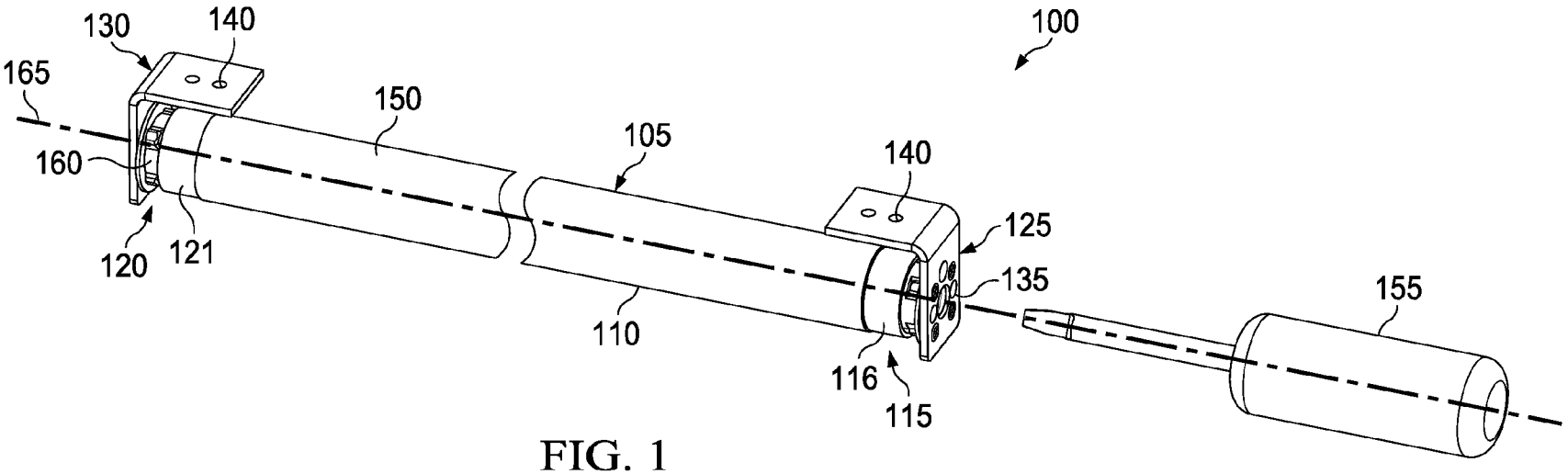
FIG. 1 illustrates an implementation of an example assembly.

FIG. 1 illustrates an implementation of an assembly 100. As illustrated, a roller shade 105 may include an elongated body 110. The elongated body may have a cross-sectional area and a length. For example, the elongated body 110 may be at least partially cylindrical, in some implementations.

The elongated body 110 may include a first end 115 and an opposing second end 120. A first end cap 116 may be disposed proximate the first end 115 and/or a second end cap 121 may be disposed proximate the second end 120 of the elongated body.

In various implementations, the roller shade may be coupled proximate a first end 115 to a first mounting bracket 125 and may be coupled proximate a second end 120 to a second mounting bracket 130.

Figure 2A:
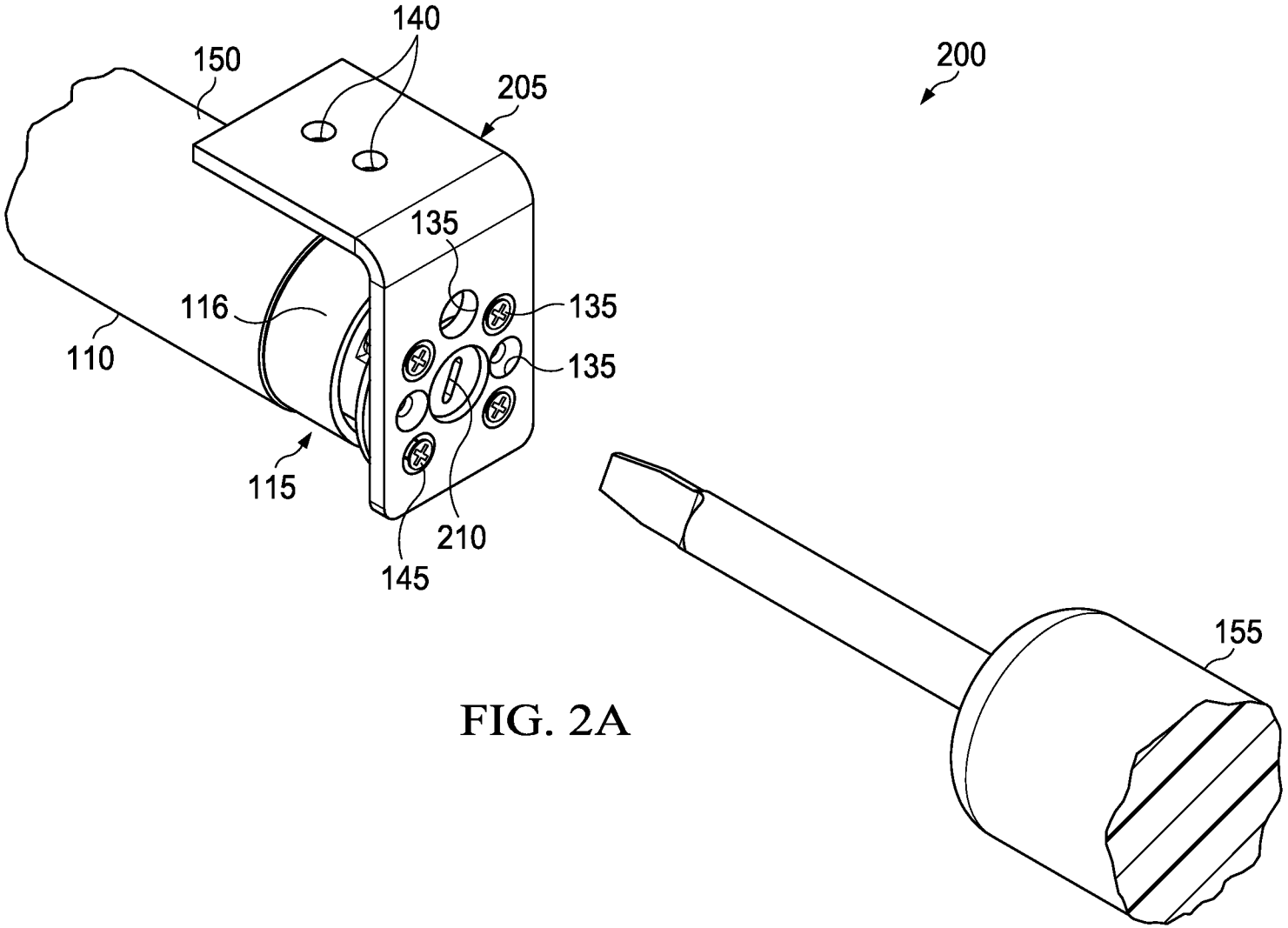
FIG. 2A illustrates a side view of an implementation of an example assembly.

The mounting bracket(s) (e.g., first mounting bracket 125 and/or second mounting bracket 130) may be L-shape in some implementations. The mounting bracket(s) may include a first coupling member 135 adapted to couple to an end of the roller shade 105 and/or a second coupling member 140 adapted to couple to a location (e.g., proximate a window of a recreational vehicle). FIG. 2A illustrates an implementation of a portion of an example assembly 200. A roller shade 105 may include coupling member(s) (not shown) proximate one or more ends of the roller shade to facilitate coupling the roller shade and the mounting bracket(s) 205. As illustrated, a fastener 145 may be disposed at least partially in an coupling member of the mounting bracket 205, such as an opening, and at least partially in a coupling member (e.g., an opening and/or an opening with threads) of the roller shade. In some implementations, the roller shade may include a coupling member such as a retractable pin. The retractable pin may couple with a coupling member of the bracket, such as a recess, to couple the roller shade and the mounting bracket.

The roller shade 105 may include a shade 150. The shade 150 may include a solar shade, a privacy shade, and/or any other appropriate type of shades. The shade 150 may be coupled at a first end to the elongated body 110 of the roller shade 105. The shade 150 may include a handle to facilitate retraction and/or release (e.g., pulling down) of the shade. The shade 150 may wrap at least partially around at least a portion of the elongated body. For example, the elongated body may include a cross-sectional area and a length. The shade may wrap at least partially around a perimeter of the cross-sectional area of the elongated body. For example, in a cylindrical elongated body, the shade may wrap one or more times around (e.g., rolled around) the circular circumference of the elongated body. The shade may extend from proximate a first end 115 of the roller shade to proximate a second end 120 of the roller shade.

In some implementations, a clearance may include the perpendicular distance between an end of a shade and a side of a mounting bracket to which the elongated body is coupled. The clearance may allow light to pass through. A low clearance may be increase satisfaction of some users since that light may be more fully blocked by the shade and/or more privacy may be allowed, in some implementations. For example, a clearance may be less than approximately 0.5 inches. A clearance may be less than approximately 0.13 inches in some implementations.

Figure 2C:
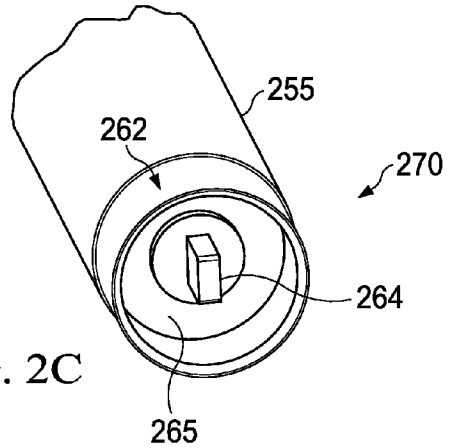
FIG. 2C illustrates an implementation of a portion of an example assembly.
Figure 2D:
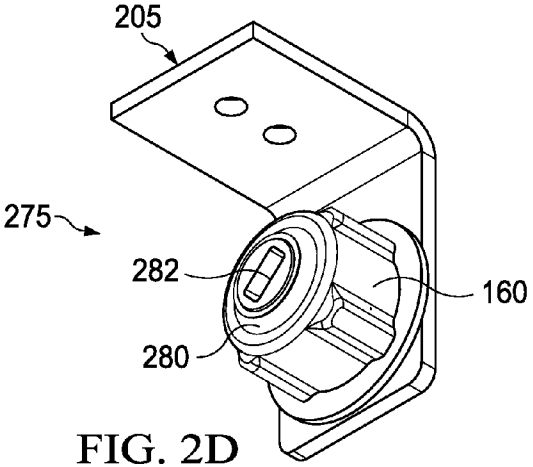
FIG. 2D illustrates an implementation of a portion of an example assembly.
Figure 2B:
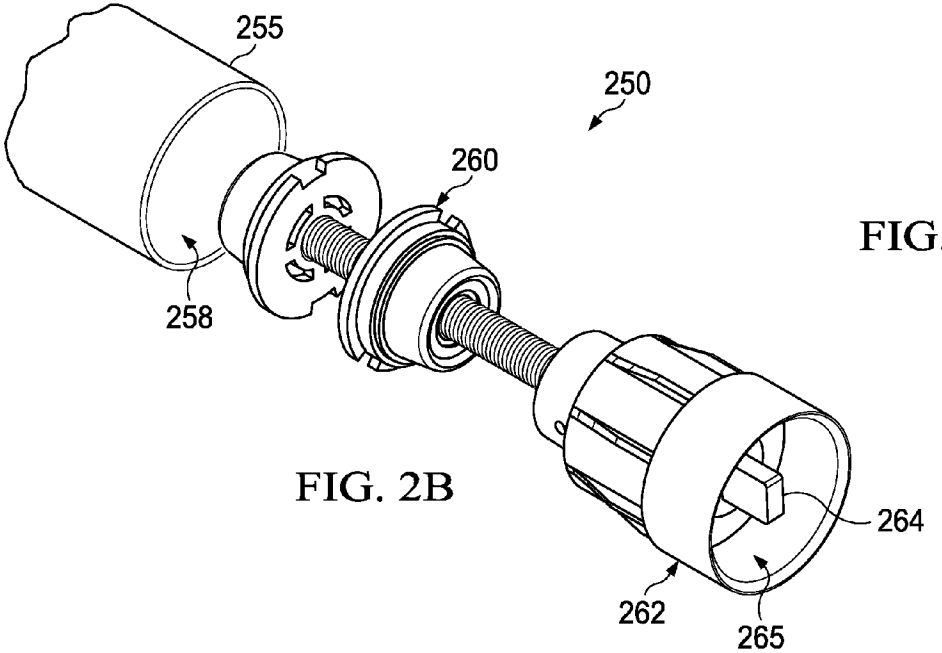
FIG. 2B illustrates an exploded view of an implementation of a portion of an example assembly.

In some implementations, the roller shade assembly may include a shaft, a mechanism, and mounting bracket(s). FIG. 2B illustrates an implementation of a portion 250 of an example assembly. As illustrated, the roller shade includes a shaft 255. An opening 258 may be disposed through the shaft 255. One or more of the internal components 260 of the roller assembly may be disposed at least partially in the opening 258 of the shaft 255.

An end cap 262 may be coupled to one or more of the internal components 260 of the roller shade. The end cap 262 may be disposed at least partially in the shaft 255 of the elongated body of the roller shade. The end cap 262 may include an activator 264. FIG. 2C illustrates an implementation of a portion 270 of an example assembly. As illustrated, the activator 264 may be disposed in an opening 265 of the end cap. The opening 265 of the end cap may include dimensions such that a mechanism may be at least partially disposed in the end cap. As illustrated, the activator 264 may include a rotatable protrusion. The activator 264 may be coupled to the internal components 260 such that actuation of the activator 264 may adjust the settings of the internal component(s). For example, the activator 264 may be rotated and rotation of the activator may adjust one or more of the internal component(s) 260 of the roller shade. In some implementations, internal component(s) may allow adjustment of auto-stop features, tensions, etc. Thus, by allowing adjustment and/or retention of adjustment to a roller shade assembly, a user satisfaction of a roller shade may be increased.

The roller shade assembly may also include a mechanism. The mechanism may allow locking, unlocking, and/or adjustment of the roller shade and/or portions thereof. FIG. 2D illustrates an implementation of an example portion 275 of an example assembly. As illustrated, the mechanism 275 may include coupling member 282 that may be coupled to the activator 264 of the end cap 262. The mechanism may include a housing 160. The gears and/or spring(s) of the mechanism may be at least partially disposed in the mechanism 280. The mechanism 280 may be disposed at least partially in an opening 265 in the end cap 262.

As illustrated, the mechanism 280 may be coupled to the mounting bracket 205. The end cap 262 of the roller shade may then be disposed on the mechanism 280 such that at least a portion of the mechanism is disposed in the end cap. By allowing the mechanism to be disposed at least partially in the end cap of the roller shade, a clearance of the roller shade may be reduced (e.g., when compared with roller shades that couple to an end of an end cap). The activator 264 of the end cap 262 may be allowed to engage with the coupling member 282 of the mechanism. The coupling member 282 may be a portion of a gear (e.g., third gear), in some implementations.

The mechanism may include gears and a spring. In some implementations, the roller shade 105 may include a mechanism proximate a first end 115 and/or a second end 120. The mechanism may include gears that engage with at least one other gear to lock, unlock, and/or adjust the roller shade and/or portions thereof. One or more of the gears may include an opening. For example, a gear may include an annular ring, as appropriate. The spring may be disposed about one or more of the gears and may be able to compress to store energy and release to exert a force and/or resist movement of a proximate member in the direction of compression of the spring.

Figure 3:
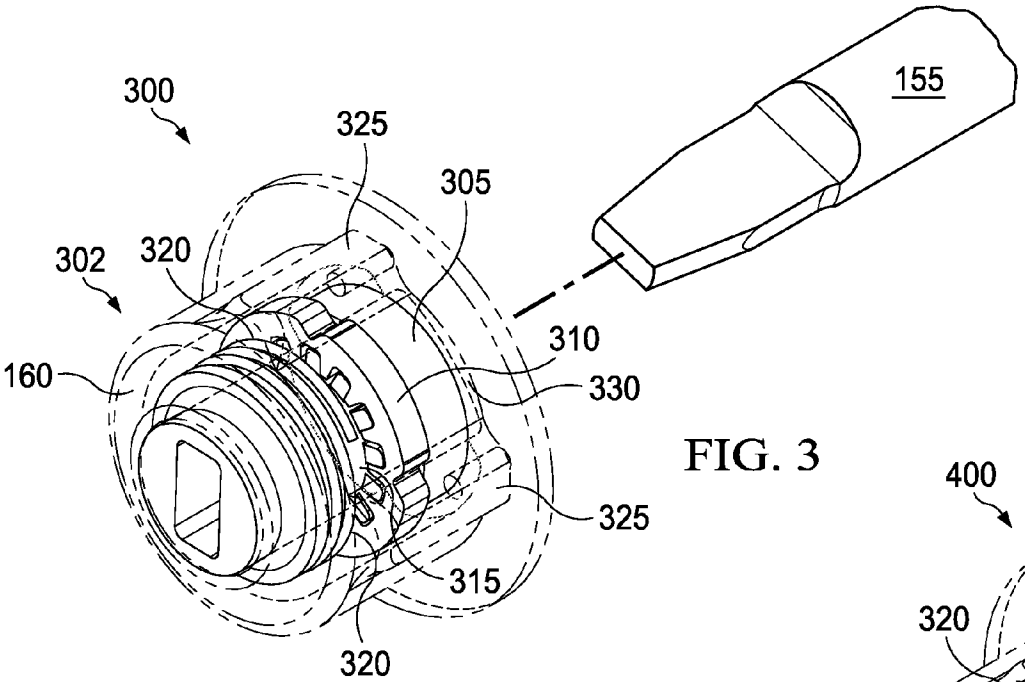
FIG. 3 illustrates an implementation of a portion of an example assembly.
Figure 4:
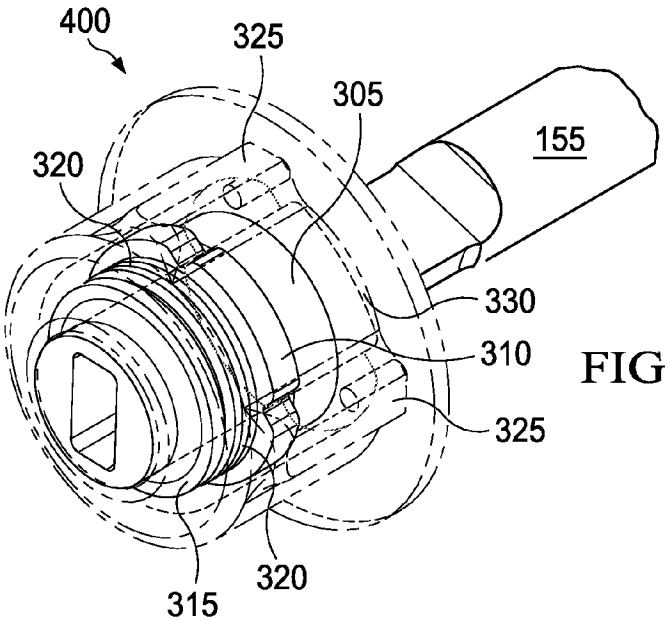
FIG. 4 illustrates an implementation of a portion of an example assembly.

FIG. 3 illustrates a cutaway view of an implementation of a portion of an example assembly 300. FIG. 4 illustrates a cutaway view of an implementation of a portion of an example assembly 400. As illustrated, the roller shade may include a mechanism 302 disposed at least partially in the elongated body and that may be actuated by a driver 155. The mechanism may include a first gear 305, a second gear 310, a third gear 315, and a spring 320. The first gear 305 may be disposed proximate a mounting bracket when coupled to the mounting bracket. The first gear 305 may be able to rotate within a housing of the roller shade. The first gear 305 may include a receiving member that is able to engage with a driver 155 of the assembly. The driver 155 may rotate when engaged with the receiving member such that the first gear rotates. The first gear 305 or portions thereof may be accessible to the driver through the housing of the roller shade. For example, the housing of the roller shade may include an opening and/or recessed portion through which a driver may be able to engage with the first gear.

Figure 5A:
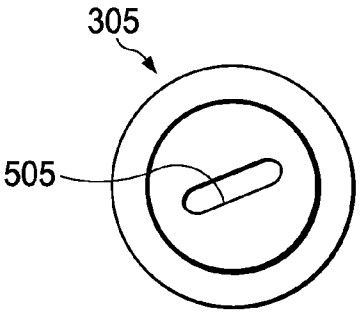
FIG. 5A illustrates a top view of an implementation of an example first gear.

FIG. 5A illustrates an implementation of an example first gear 305 with a receiving member 505. For example, the receiving member may include a recess adapted to engage with a driver, such as a screwdriver and/or an Allen wrench. The receiving member may include a protrusion adapted to engage with a socket wrench, in some implementations. The receiving member may be accessible to a user when the roller shade is coupled to a mounting bracket (e.g., such that a driver may engage with the receiving member of the roller shade).

The second gear 310 may be disposed proximate the first gear 305. The second gear 310 may include an opening, an inner perimeter, and/or an outer perimeter. The second gear 310 may be an annular ring, in some implementations. The second gear may contact at least a portion of the first gear 305.

Figure 5B:
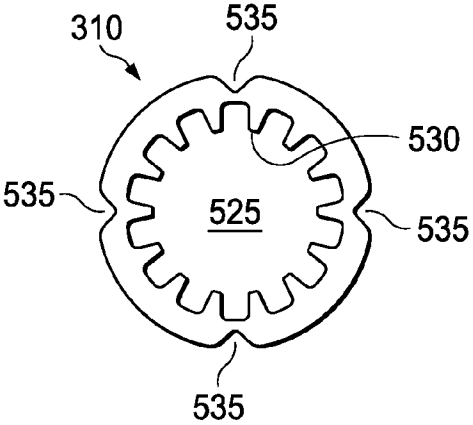
FIG. 5B illustrates a top view of an implementation of an example second gear.

FIG. 5B illustrates an implementation of an example second gear 310. The second gear 310 may include an opening 525. The second gear 310 may include one or more coupling members 530 disposed proximate the inner perimeter of the second gear (e.g., an inner circumference of an annular ring) and adapted to couple with the third gear. The coupling member may include recesses, such as grooves, to engage with a coupling member of the third gear 315. The recesses in the second gear may form protrusions such as teeth extending into the opening of the second gear. The protrusions may engage with recesses between protrusions of the third gear. For example, as illustrated, the second gear 310 may include grooves disposed about the opening of the second gear 310.

In some implementations, rotation of the second gear may be inhibited. For example, the second gear may include one or more recesses adapted to couple with at least a portion of a housing 160 of the roller shade. For example, the second gear may include one or more recesses disposed about an outer perimeter of the second gear. The recesses may engage with protrusions (e.g., elongated protrusions, tracks, and/or tongues) of the housing. When the recesses disposed about an outer perimeter of the second gear are engaged with the protrusions of the housing, the rotation of the second gear may be restricted and/or inhibited. As illustrated, the second gear may include four grooves 535 disposed about an outer perimeter of the second gear. A groove 530 may couple with a protrusion 325 (e.g., a tongue) of the housing 160. By engaging the recess with at least a portion of the housing (e.g., by engaging a groove with a tongue of the housing), as illustrated, rotation of the second gear may be inhibited.

In some implementations, the second gear may include one or more protrusions adapted to engage with at least one recess in the housing. When the protrusion(s) in the second gear are engaged with the recess(es) of the housing, rotation of the second gear may be restricted.

Figure 5C:
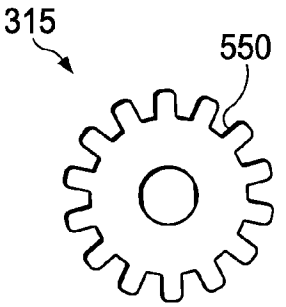
FIG. 5C illustrates a top view of an implementation of an example third gear.
Figure 5D:
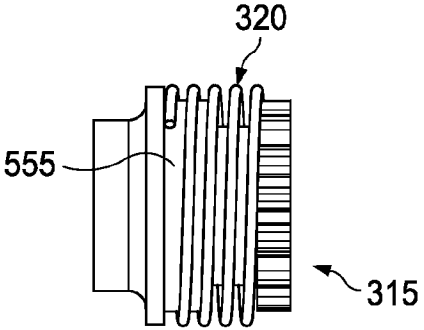
FIG. 5D illustrates a side view of an implementation of an example third gear.

The third gear 315 may be disposed proximate the second gear 315. The third gear may be disposed at least partially in an opening of the second gear 315 and/or an opening of the first gear 305. FIG. 5C illustrates a top view of an implementation of an example third gear 315. FIG. 5D illustrates a side view of an implementation of the example portion of the roller shade that includes the third gear 315 and a spring. As illustrated, the third gear may include a coupling member 550 adapted to engage with the coupling member 530 of the second gear. For example, the coupling member 550 of the third gear 315 may include protrusions such as teeth. One or more of the protrusions of the third gear may couple with one or more of the recesses of the second gear, in some implementations. For example, a protrusion of the third gear may engage with at least one recess of the second gear. In some implementations, a recess between two protrusions may engage with a protrusion of the second gear. As illustrated, the third gear may include a shaft 555.

The spring 320 of the roller shade may be disposed about at least a portion of the shaft of the third gear. In some implementations, the spring 320 may extend along the shaft of the third gear. The spring may contact the first gear 305 and/or the second gear 310. In some implementations, the spring may extend from the shaft of the third gear 315 to a plate 330 of the housing. The first gear 305 may contact the plate 330 of the housing in some positions of the mechanism.

Figure 5E:
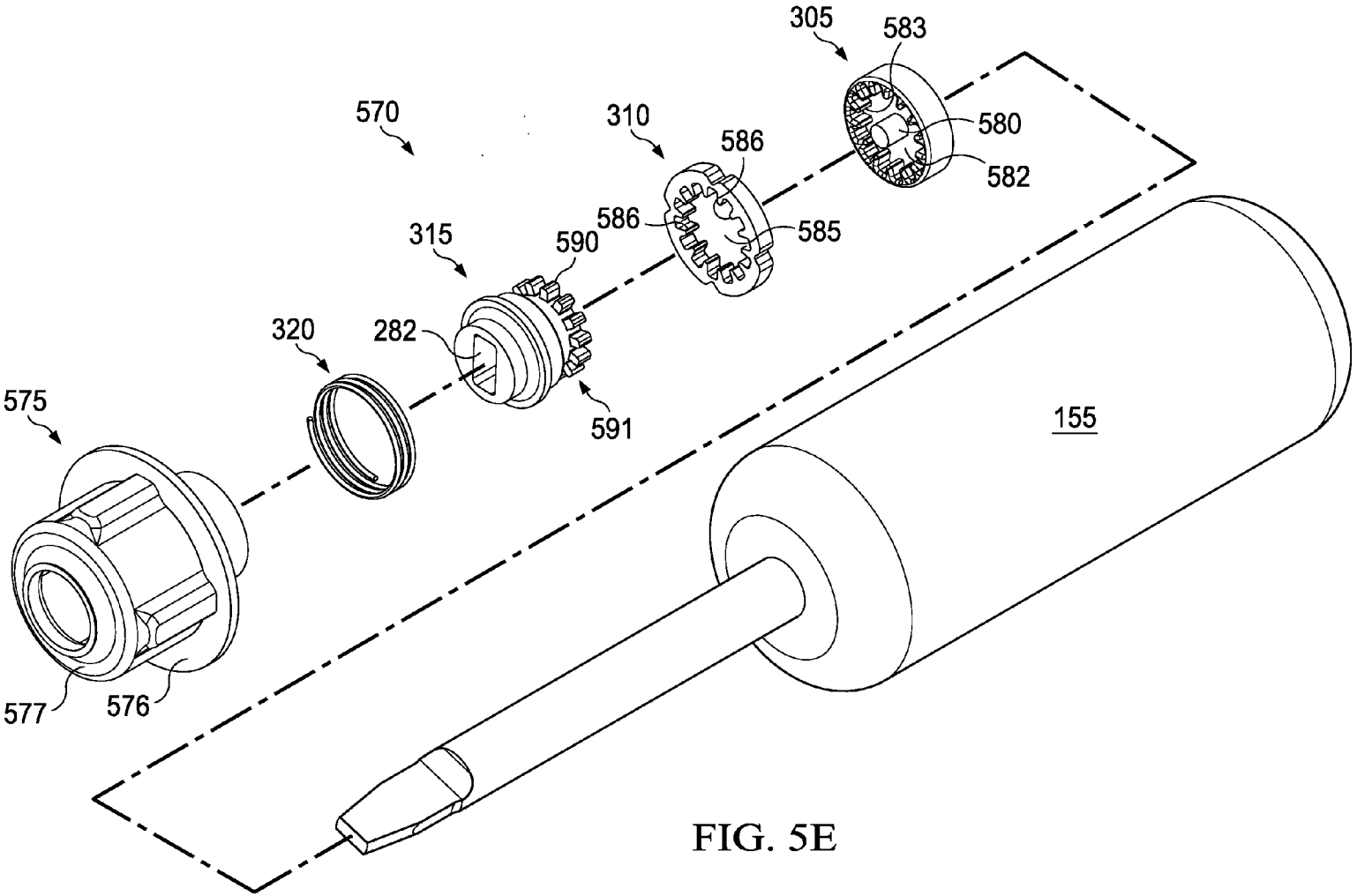
FIG. 5E illustrates an exploded view of an implementation of portion of an example mechanism of a roller shade.

FIG. 5E illustrates an exploded view of a portion 570 of the assembly. An exploded view of the mechanism of the roller shade at least partially illustrated in FIG. 5E. The mechanism may include a first gear 305, a second gear 310, a third gear 315, a spring 320 and a coupler 575. The first gear 305 includes a receiving member that engages the driver 155. The receiving member may be a recess 580 that extends into a portion of the first gear 305. The first gear 305 may include a recessed portion 582. At least a portion of the third gear 315 may extend into the recessed portion 582 of the first gear 305. The first gear 305 may include protrusions 583 and/or recesses adapted to engage with protrusions and/or recesses of the third gear. The protrusions 583 and/or recesses of the first gear 305 may be disposed in the recessed portion 582 of the first gear. The protrusion(s) 584 may engage with at least one recess between protrusions in the third gear 315.

The second gear 315 may include an opening 585. The second gear 315 may include protrusions 587 and/or recesses disposed about the opening 585. The protrusions 587 may extend into the opening 585 of the second gear, in some implementations. The protrusions 587 of the second gear may align with the protrusions 583 of the first gear, in some implementations. For example, to lock the roller shade the protrusions 586 of the second gear and the protrusions 583 of the first gear 505 may be engaged by recesses (e.g., disposed between protrusions) of the third gear. In The third gear 315 may include protrusions 590 and/or recesses proximate a first end 591 of the third gear. At least a portion of the third gear 315 may pass through the second gear 310. At least a portion of the third gear 315 may reside in and/or be at least partially retained by the recessed portion 582 and/or the protrusions 583 of the first gear.

A spring 320 may be included in the mechanism to maintain a default position of the roller shade. For example, the spring 320 may be disposed about at least a portion of the third gear 320. In some implementations, the spring 320 may extend such that at least a portion of the first gear 305, second gear 310, and/or third gear 315 are disposed in the spring.

A coupler 575 may be included in the mechanism. The coupler may facilitate coupling of the mechanism and the shaft of the elongated body of the roller shade. The third gear may at least partially be disposed in the coupler 575. As illustrated, the spring 320, the third gear 315, the second gear 310, and the first gear are disposed in a recess of the coupler 575. In the default position, the spring may be at least partially expanded and the first gear may be disposed such that a surface of the first gear is approximately planar with the plate 576 of the coupler 575.

When the driver 155 is engaged with the receiving member of the first gear 305 and force is applied by the driver, the first gear may move away from the plate 576 of the coupler 575 towards an opposing end 577 of the coupler. The force applied by the driver on the first gear 305 may be at least partially transferred to the second gear 310, which may move away from plate 576 towards the opposing end 577 of the coupler 575. By allowing the second gear 310 to move away from the first plate, the recesses of the second gear may be disengaged from the protrusions of the third gear to unlock the roller shade. The force applied to the second gear 310 may be at least partially transferred to the spring (e.g., the spring may be disposed about the third gear 315 and contact at least a portion of the second gear), and cause the spring to be at least partially compressed.

In some implementations, a cover, such as a plate (not shown) may be disposed such that the first gear is at least partially retained in the coupler 575. For example, the cover may couple with the plate 576 of the coupler 575. The cover may include an opening through which the receiving member of the first gear may be accessed.

Although FIGS. 1-5E illustrate implementations of example assemblies, other implementations and/or combinations of the illustrated example assemblies may be utilized. For example, a roller shade may include a single mounting bracket and one or more ends of the roller shade may be coupled to the mounting bracket. In some implementations, the shade may include a handle. The shade may wrap around a circumference of the elongated body more than one time. Gear(s) may be at least partially disposed in a housing of the roller shade.

In some implementations, the gears of the roller shade may inhibit and/or reduce slippage of portions of the roller tube during adjustments and/or after adjustments. For example, the gears may engage with at least one other gear to lock the roller shade and inhibit the spring from slipping. The gears may exert a positive lock such that slippage the spring against a shaft of the roller shade may be inhibited.

In various implementations, the roller shade may be locked and/or unlocked. For example, the mechanism may include more than one position. In a first position, the roller shade may be locked (e.g., adjustment of one or more internal components may be inhibited). For example, when the roller shade is locked, rotation of the third gear may be inhibited and thus rotation of the activator of the end cap may be inhibited. In a second position, the roller shade may be unlocked. In various implementations, one or more internal components of the roller shade may be adjusted when the roller shade is unlocked. For example, one or more internal components of the roller shade may allow adjustments to be made to height, supports, and the light gap between the outer roller shade and the location in which the roller shade is coupled (e.g., a window), tension, etc. For example, a height of a roller shade may be adjusted. A tension of the extension and retraction of the shade may be adjusted, in some implementations.

In some implementations, as illustrated in FIGS. 1-4, the position of the roller shade (e.g., the mechanism of the roller shade) may be adjusted. A position of the mechanism may be the default position, in some implementations. For example, the default position may be locked. As illustrated, the mechanism at rest (e.g., when not acted upon by external forces applied by a driver) may be in a locked position. The locked position may at least partially secure the roller shade tube in place (e.g., and inhibit adjustment of the internal components of the roller shade). The locked position may allow the elongated body 110 of the roller shade 105 to rotate about its axis (e.g., axis 165), and thus allow the shade 150 to be at least partially raised (e.g., at least partially retracted) or at least partially lowered.

In some implementations, adjustment of the internal components may be allowed via the first end 115 or the second end 120 of the roller shade. To adjust the position of one or more internal components of the roller shade 105 (e.g., the upper travel limits and/or the tension of the retract spring), the assembly allows a driver 155, such as a flat screwdriver, to be inserted into an end of the mechanism. For example, the driver 155 may be inserted into a receiving member 210, illustrated as a slot. Rotating and applying pressure via the driver may allow one or more internal adjustments of associated components.

As illustrated, in the locked position, the spring 320 pushes the second gear 310 (e.g., a ring gear) back against the first gear 305 and the grooves of the second gear (e.g., teeth formed by grooves in the inner annular diameter of the second gear) may engage with the teeth of the third gear. The housing 160 (e.g., an outer housing of the roller shade) may include an outer tongue and grove design, which may inhibit rotation of the second gear 310. A tongue of the housing may capture a groove in an outer surface of the second gear, and the grooves of the second gear may capture the teeth of the third gear to restrict movement of the second gear and/or third gear (e.g., turning of the second gear and/or third gear may not be allowed). Second gear 310 may be secured from rotating by one or more outer grooves (e.g., four) that secure into corresponding protrusions (e.g., elongated protruded tracks) in housing 160, in some implementations.

To "unlock" and adjust the internal components, a driver 155 (e.g., a flat screw driver) may be inserted into the first gear, and pushed into the housing 160. The force may move the second gear forward (e.g., away from a plate 330 of the roller shade), and may disengage the teeth of the third gear. Since the third gear is unlocked (e.g., the teeth of the third gear are free to rotate since the teeth are not engaged with the grooves of the second gear), rotation of the driver turning the first gear 305 may allow rotation of the third gear. Rotation of the third gear 315 may affect one or more internal roller shade components and/or allow adjustment of one or more of the internal components. When the desired internal components adjustment(s) are made, removing the driver from the first gear 305 may causes the spring 320 to push the second gear back to engage with the teeth of the third gear 315. Thus, the roller shade may be locked with the adjustment(s) in place.

Figure 6:
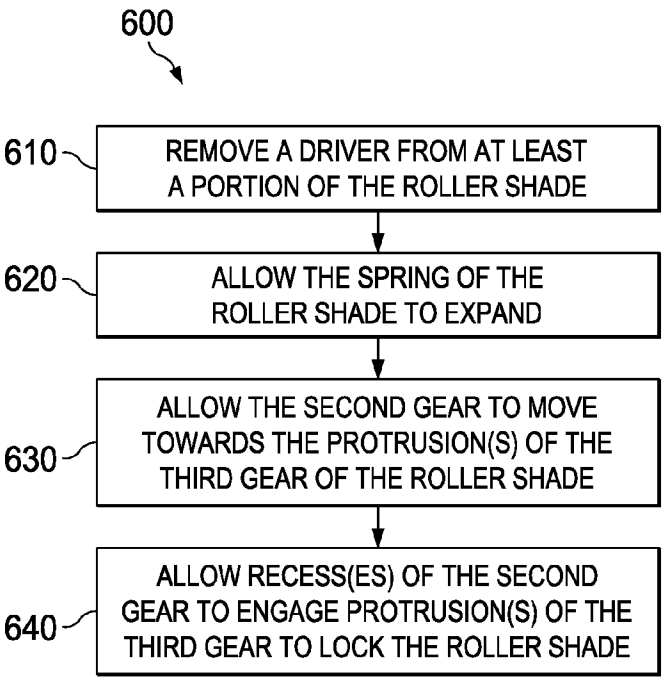
FIG. 6 illustrates an implementation of an example process for locking the roller shade.

FIG. 6 illustrates an implementation of an example process 600 for locking the roller shade. A driver may be removed from at least a portion of the roller shade (operation 610). For example, a screwdriver may be removed from a receiving member, such as a recess, of the first gear of a roller shade. The driver may exert a force on the first gear of the roller shade when the driver is engaged with the first gear. At least a portion of the force exerted on the first gear may be transferred to the second gear of the roller shade and/or the spring of the roller shade (e.g., the force may cause the first gear to exert a force on the second gear and/or the spring).

The spring of the roller shade may be allowed to expand (operation 620). When the driver is removed, the force exerted on the spring via the first gear and/or second gear may be removed. When the force is removed, the energy stored in the at least partially compressed spring may be released and the spring may be at least partially expanded.

The second gear of the roller shade may be allowed to move towards the protrusion(s) of the third gear of the roller shade (operation 630). For example, the second gear, when force is applied to the first gear, may be disposed such that the protrusions of the third gear are not engaged with the groove or other recess of the second gear. Thus, when the force of the driver is removed, the at least partially expanding spring may exert at least a portion of the stored energy of the spring on the second gear to move the second gear. The protrusions may be teeth disposed about an exterior surface of the third gear. The grooves may be disposed about a surface proximate the opening of the second gear (e.g., proximate the inner annular radius).

Recess(es) of the second gear may be allowed to engage the protrusion(s) of the third gear to lock the roller shade (operation 640). For example, as the second gear moves towards the teeth of the third gear, the grooves in the second gear may be pushed by the expanding spring toward the teeth such that at least a portion of the teeth of the third gear engage the grooves of the second gear. The roller shade may be locked (e.g., adjustment of internal components may be inhibited) when at least a portion of the protrusions of the third gear are engaged with the grooves of the second gear.

Process 600 may be implemented by various assemblies, such as assembly 100, 200, 300, and/or 400. In addition, various operations may be added, deleted, and/or modified. For example, the driver may not be disengaged. In some implementations, the roller shade may lock when the driver does not apply a force to at least a portion of the roller shade. In some implementations, the spring may contact a plate (e.g., plate 330 illustrated in FIG. 4) of the housing. Thus when a force is applied to the plate (e.g., by the driver and/or via the first gear), at least a portion of the force may be transferred to the spring and at least partially compress the spring. In some implementations, adjustment of one or more of the internal component(s) of the roller shade may be inhibited when the roller shade is locked. In some implementations, adjustment of one or more internal components of the roller shade may be allowed using the driver. For example, the driver may exert a force and may rotate to cause one or more portions of the roller shade to rotate and adjust internal component(s). After the adjustment has been made to the roller shade, the driver may be disengaged and/or a force applied by the driver may be removed from the roller shade. The roller shade may then lock after the allowed adjustment of the roller shade. The adjustments may be maintained by the roller shade after locking the roller shade.

Figure 7:
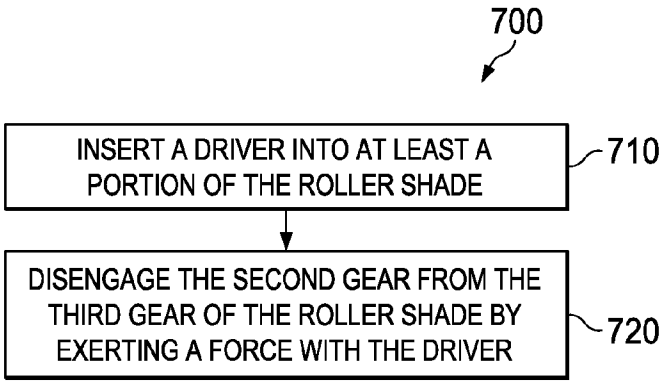
FIG. 7 illustrates an implementation of an example process for unlocking the roller shade.

In various implementations, the roller shade may be unlocked. FIG. 7 illustrates an example process 700 for unlocking the roller shade. A driver may be inserted into at least a portion of the roller shade (operation 710). For example, a driver, such as a screwdriver may engage with at least a portion of the first gear (e.g., the receiving member) of the roller shade.

The second gear of the roller shade may be disengaged from the third gear of the roller shade by exerting a force with the driver (operation 720). The second gear may be disposed proximate the first gear of the roller shade. The third gear may be disposed at least partially in the second gear and/or first gear. For example, the third gear may include a shaft about which the second gear and/or first gear are at least partially disposed. When a force is applied by the driver engaged with the first gear, at least a portion of the force may be transferred to a spring of the roller shade. For example, at least a portion of the force may be transferred to the first gear, second gear, and/or plate of the roller shade. At least a portion of the force from the first gear, second gear, and/or plate of the roller shade may then be transferred to the spring to at least partially compress the spring. For example, the spring may contact the second gear and by transferring force from the driver to the first gear and thus the second gear, the second gear may be moved away from the plate of the roller shade and compress the spring. As the second gear moves away from the plate of the roller shade, the grooves of the second gear may be disengaged from the teeth of the third gear and the roller shade may be unlocked.

Process 700 may be implemented by various assemblies, such as assembly 100, 200, 300, and/or 400. In addition, various operations may be added, deleted, and/or modified. In some implementations, process 700 may be performed in combination with other processes such as process 600. For example, the driver may move the first gear and the second gear away from the plate of the roller shade. In some implementations, the roller shade may be locked (e.g., by disengaging the driver and/or removing the force applied by the driver). For example, the driver may be disengaged from the first gear and the spring may be allowed to exert a force on the second gear such that one or more grooves of the roller shade engage with one or more teeth of the third ring to lock the roller shade.

In some implementations, adjustment of one or more internal components of the roller shade may be allowed when the roller shade is unlocked. One or more of the internal components may be adjusted by rotating the driver. Since the driver is engaged with the first gear of the roller shade, rotating the driver may rotate the first gear and allow adjustment of internal component(s). For example, rotating the first gear of the roller shade using the driver may rotate the third gear of the roller shade to adjust one or more internal components of the roller shade. In some implementations, rotation of the second gear may be inhibited. For example, the second gear may include grooves that are capable of engaging with protrusions, such as tongues, of the housing, and inhibiting rotation of the second gear. Thus, when the spring is compressed by the exertion of force by a driver, the second gear may move along a protrusion of the housing and compress the spring. The protrusion may restrict rotation of the second gear in a locked and/or unlocked position.

In some implementations, the mechanism of the roller shade assembly may be utilized with standard and/or existing roller shades. For example, an end cap of the roller shade may be disengaged from an existing mounting bracket and coupled to the mechanism.

In some implementations, the roller shade assembly may be adjusted without removing the shaft and/or elongated body of the roller shade from the mounting bracket. For example, the roller shade may be unlocked by engaging (e.g., via a driver) a receiving member of the first gear of the mechanism through the mounting bracket. The roller shade may then be adjusted to a setting (e.g., by rotating the driver and/or otherwise actuating the driver). Further adjustment to the setting may be inhibited by locking the roller shade (e.g., by disengaging the driver).

In some implementations, the roller shade may be adapted such that one or more of the end caps may be positioned relative to the shaft in more than one position. For example, when pressure is applied to an end cap, the end cap may further retract into a shaft. By allowing more than one position for an end cap, positioning and/or mounting of a shaft onto the mounting bracket and/or mechanism may be facilitated. For example, a mechanism may be coupled to the mounting bracket (e.g., via fasteners). The shaft of the roller shade may be coupled to the mounting bracket by applying pressure to an end cap to allow the end cap to retract to a second position. The shaft and end cap may be positioned such that the mechanism is disposed at least partially in the end cap and then the pressure applied to the end cap may be released. By releasing the pressure on the end cap, the shaft may be coupled to the mechanism and the mounting bracket.

Although various shapes have been described in the description of various assemblies, other shapes may be utilized as appropriate. For example, the elongated body may include an oval cross-sectional shape and a length.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a shade" includes a combination of two or more shades; and, reference to "a gear" includes different types and/or combinations of gears. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A method of adjusting a roller shade, the method comprising:

inserting a driver into at least a portion of a first gear of a roller shade;

disengaging a second gear of the roller shade disposed proximate the first gear from a third gear of the roller shade by exerting a force with the driver; and allowing adjustment of one or more internal components of the roller shade by rotating the driver.

2. The method of claim 1 wherein rotating the driver comprises rotating the first gear.

3. The method of claim 1 wherein rotating the driver comprises rotating the first gear, and wherein rotating the first gear rotates the third gear to adjust one or more internal components.

4. The method of claim 1 further comprising exerting a force with the driver on the first gear, and wherein exerting the force with the driver compresses a spring contacting the second gear.

5. The method of claim 1 wherein disengaging the second gear comprises disengaging grooves of the second gear from teeth of the third gear.

6. The method of claim 1 further comprising locking the roller shade such that adjustment is inhibited.

7. The method of claim 1 further comprising:

removing the driver;

locking the roller shade by removing the driver.

8. The method of claim 1 further comprising:

removing the driver; and allowing a spring of the roller shade to exert a force on the second gear such that grooves of the second gear engage with teeth of the third ring to lock the roller shade.

9. A method of adjusting a roller shade, the method comprising:

removing a driver from at least a portion of a roller shade, wherein the driver exerted a force on a first gear of the roller shade, and wherein the first gear exerts at least a portion of the force on a second gear and a spring of the roller shade;

allowing the spring of the roller shade to expand by removing driver;

allowing the second gear to move towards teeth of a third gear of the roller shade by allowing the spring to expand; and allowing groove of the second gear to engage the teeth of the third gear to lock the roller shade.

10. The method of claim 9 further comprising unlocking the roller shade.

11. The method of claim 9 further comprising unlocking the roller shade by:

inserting the driver into at least a portion of the first gear of the roller shade; and disengaging the second gear of the roller shade disposed proximate the first gear from the third gear of the roller shade by exerting a force with the driver.

12. The method of claim 11 further comprising allowing adjustment of one or more internal components of the roller shade by rotating the driver.

13. The method of claim 12 further comprising locking the roller shade after allowing adjustment by removing the driver from the first gear of the roller shade.

* * * * *